US005934531A

United States Patent [19]

Jablonic et al.

[11] Patent Number: 5,934,531

[45] Date of Patent: Aug. 10, 1999

[54] LEG MOUNTED QUIVER

[76] Inventors: Mark D. Jablonic, N27 W27721 Jocelyn Ct., Pewaukee, Wis. 53072; Lance E. Jablonicky, 101 S. 2nd St., Colby, Wis. 54421

[21] Appl. No.: 09/019,615

[22] Filed: Feb. 6, 1998

[51] Int. Cl.[6] ..... A45F 5/00; F41B 5/00

[52] U.S. Cl. ..... 224/222; 224/267; 224/271; 224/916

[58] Field of Search ..... 224/191, 222, 224/267, 271, 272, 916; D3/221; 124/86

[56] References Cited

U.S. PATENT DOCUMENTS

| | | | |
|---|---|---|---|
| D. 282,271 | 1/1986 | Morrell | D3/221 |
| 1,583,181 | 5/1926 | Rubio | 224/267 |
| 1,761,497 | 6/1930 | Smith | 224/222 |
| 2,691,399 | 10/1954 | Tompkins | 150/1.5 |
| 2,715,990 | 8/1955 | Austin . | |
| 2,722,958 | 11/1955 | King et al. | 150/1.5 |
| 2,746,658 | 5/1956 | Freid . | |
| 2,768,669 | 10/1956 | Kinnee | 150/1.5 |
| 2,881,817 | 4/1959 | Brion | 150/1.5 |
| 2,908,432 | 10/1959 | Kent . | |
| 2,987,230 | 6/1961 | Taylor . | |
| 3,040,942 | 6/1962 | Cote . | |
| 3,208,653 | 9/1965 | Wallace . | |
| 3,232,501 | 2/1966 | Merenda . | |
| 4,103,807 | 8/1978 | Lyon et al. . | |
| 4,621,752 | 11/1986 | Youngbauer . | |
| 4,848,624 | 7/1989 | Clem | 224/222 |
| 4,974,762 | 12/1990 | Boretsky et al. | 224/222 X |
| 5,193,725 | 3/1993 | Radocy | 224/197 |
| 5,358,108 | 10/1994 | Celaya | 224/916 X |
| 5,487,374 | 1/1996 | Herminath et al. | 124/86 |
| 5,593,121 | 1/1997 | Tackett | 224/916 X |
| 5,664,721 | 9/1997 | Homeyer | 224/651 |

FOREIGN PATENT DOCUMENTS

| | | | |
|---|---|---|---|
| 72856 | 12/1947 | Norway | 224/222 |

*Primary Examiner*—Gregory M. Vidovich
*Attorney, Agent, or Firm*—Andrus, Sceales, Starke & Sawall

[57] ABSTRACT

A quiver assembly and mounting arrangement for positioning a supply of arrows along the lower leg of an archer. The mounting arrangement includes a base member having a first end, a second end, and a support portion between the first and second ends. The first end of the base member is coupled to an upper attachment strap that surrounds the lower leg of the archer to securely hold the first end of the base member in position relative to an upper portion of the archer's leg. A lower attachment strap is coupled to the second end of the base member to hold the second end of the base member in position relative to a lower portion of the archer's leg. The lower attachment strap is looped about the foot of the archer, and is preferably formed from a loop of elastic material such that the quiver mounting arrangement can be used with a wide variety of footwear. A mounting bracket is retained on the base member and receives and retains a mounting portion of the quiver. The quiver mounting assembly allows the archer to conveniently position a quiver along his or her lower leg when hunting.

11 Claims, 1 Drawing Sheet

LEG MOUNTED QUIVER

BACKGROUND OF THE INVENTION

The present invention relates generally to a quiver for holding arrows to be used by an archer. More specifically, the present invention is a quiver mounting arrangement that positions a quiver and a supply of arrows along the lower leg of an archer.

A quiver is generally a container for conveniently holding and positioning a supply of arrows to be used by an archer. A quiver generally allows an archer to have convenient access to the supply of arrows during a variety of activities, such as recreational shooting, tournament competition or bow hunting.

Although the position of the quiver is important when the archer is participating in recreational shooting and tournament competitions, the position of the quiver becomes extremely important when the archer is bow hunting. When bow hunting, it is important that the archer have quick and easy access to his supply of arrows without having to make any sudden or awkward movements, since such movements can startle the wild game being hunted.

Currently, numerous types of bow quivers are available for use while bow hunting. Modern arrow quivers generally fall into one of three categories: back quivers, bow quivers or hip quivers. A back quiver mounts the quiver to the back of the archer, thereby allowing the archer to reach over his shoulder and grab one of the supply of arrows. A bow quiver is secured directly to the archer's bow, such that the supply of arrows is always positioned near the bow itself. Currently available hip quivers are typically attached to the belt of the archer and position the supply of arrows along the archer's hip. Additionally, quiver mounting arrangements are available that allow the archer to mount the quiver to a stationary object, such as a tree, so that the arrows can be securely positioned near the archer.

Although the variety of types of arrow quivers and mounting arrangements described above function reasonably well in different types of hunting scenarios, each quiver suffers from certain drawbacks when the archer is in a seated position, as is often the case when bow hunting. When the archer is in the seated position, such as when the archer is in a tree stand, it is difficult and often times noisy for the archer to retrieve arrows from the numerous types of arrow quivers described above.

Therefore, it is an object of the invention to provide a quiver mounting arrangement that mounts an arrow quiver to the lower portion of an archer's leg such that the supply of arrows is readily available when the archer is in a seated position. It is a further object of the invention to provide a quiver mounting arrangement that can accept and mount a variety of commercially available quivers. It is a further object of the invention to provide a quiver mounting arrangement that can be adjusted to be used by a variety of archers.

BRIEF SUMMARY OF THE INVENTION

The present invention is a quiver mounting arrangement for positioning a quiver along the outside of the lower leg of an archer. By using the quiver mounting arrangement of the present invention, an archer can position arrows in a readily accessible, convenient position for use when bow hunting, particularly when seated in a tree stand. The quiver mounting arrangement of the present invention includes a base member having a first end, a second end, and a support portion positioned between the first and second ends. The first end of the base member is coupled to an upper attachment strap. The upper attachment strap has a length sufficient to encompass the lower leg portion of the archer slightly below the knee. The upper attachment strap passes around the lower leg of the archer to secure the first end of the base member to the lower leg of the archer.

A lower attachment strap is coupled to the second end of the base member to secure the base member to the lower portion of the archer's leg. In particular, the lower attachment strap passes around the foot of the archer to prevent the base member from being pulled away from the archer's leg. The lower attachment strap is preferably a loop of elastic material.

A mounting bracket is removably attached to the support portion of the base member. The mounting bracket mates with a mounting portion contained on the quiver, such that the quiver can be removably attached to the base member via the mounting bracket.

In a second embodiment of the invention, the base member and the archer's clothing each include mating portions of a plurality of snap devices. The archer can attach the base member to his or her clothing by connecting the mating portions of the snap devices to eliminate the need for the upper attachment strap.

In both embodiments of the invention, the lower attachment strap prevents the base member from being led away from the archer's leg when an arrow is pulled out of the quiver. Since the lower attachment strap is preferably formed from an elastic material, the lower attachment strap can accommodate a variety of types of footwear.

Other features and advantages of the invention may be apparent to those skilled in the art upon inspecting the following drawings and description thereof.

BRIEF DESCRIPTION OF THE DRAWINGS

The drawings illustrate the best mode presently contemplated of carrying out the invention.

In the drawings.

DETAILED DESCRIPTION OF THE DRAWINGS

Figure 2:
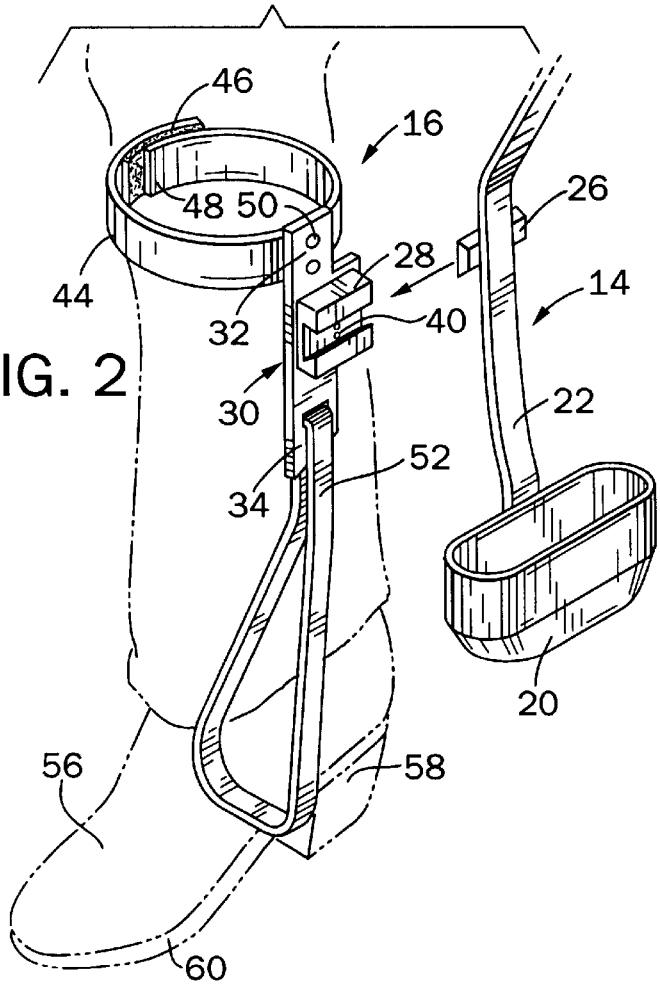
FIG. 2 is an isometric view showing the quiver mounting arrangement of the present invention as attached to the leg of an archer.
Figure 1:
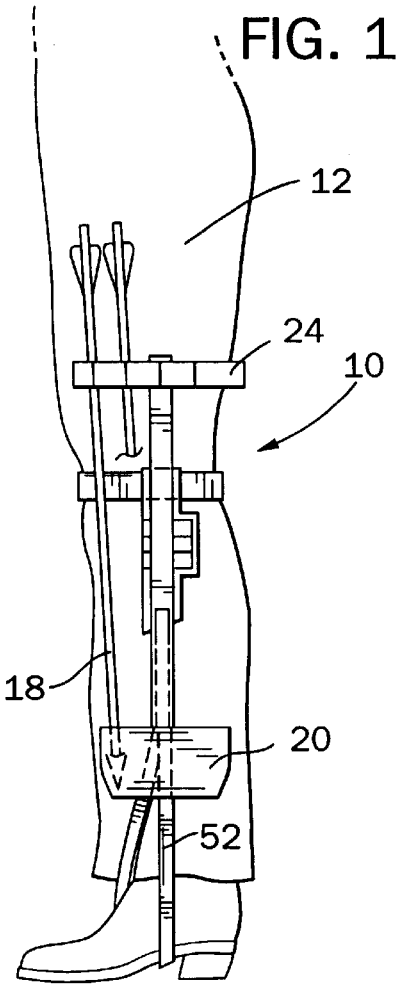
FIG. 1 is a side elevation view of a quiver mounted to the leg of an archer utilizing the quiver mounting arrangement of the present invention.

FIG. 1 shows the quiver assembly 10 of the present invention as mounted to the leg 12 of an archer. The quiver assembly 10 generally includes a quiver 14 and a quiver mounting arrangement 16, as shown in FIG. 2. The quiver 14 is a commercially available apparatus, such as that available from Martin Archery under its designation Martin Super Quiver for securing a supply of arrows 18. The specific configuration of quiver 14 does not form part of the present invention, and it is understood that the quiver mounting arrangement 16 may be used to mount any satisfactory commercially available quiver to the leg 12 of an archer. The quiver 14 generally includes a lower compartment 20, a support rod 22, and an upper retaining member 24. The lower compartment 20 supports the tips of each arrow 18, while the upper retaining member 24 includes foam receptacles that secure the upper portion of each arrow 18 as shown in FIG. 1.

The quiver 14 further includes an attachment portion 26 that is securely attached to the support rod 22. The attachment portion 26 is sized and shaped to be received and retained by a mounting bracket 28. As shown in FIG. 2, the attachment portion 26 and the mounting bracket 28 have a mating tongue and groove configuration such that the attachment portion 26 can be received by the mounting bracket 28. Although a mating tongue and groove configuration is shown in the preferred embodiment, it should be understood that other mating configurations for the attachment portion 26 and the mounting bracket 28 could be used while operating within the scope of the present invention. It should also be understood that when a typical quiver 14 is purchased, the mounting bracket 28 is included with the quiver 14 for mounting the quiver 14 to either a bow or a stationary structure. In the quiver assembly 10 of the present invention, the mounting bracket 28 is secured to the quiver mounting arrangement 16 such that the quiver 14 can be mounted to the quiver mounting arrangement 16 as shown in FIG. 2.

Figure 3:
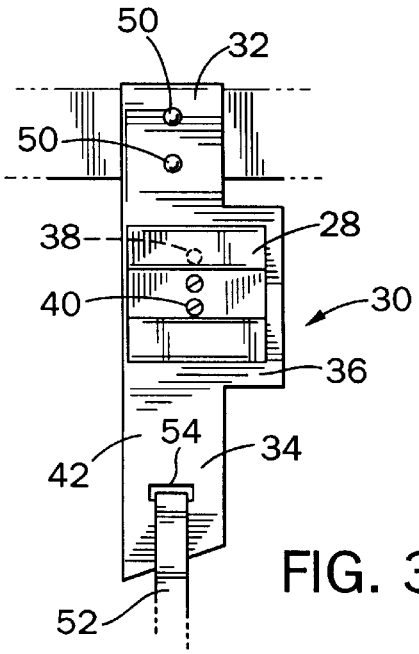
FIG. 3 is an enlarged detail view of the base member of the quiver mounting arrangement.

Referring to FIGS. 2 and 3, the quiver mounting arrangement 16 of the present invention generally includes a base member 30 having a first end 32 and a second end 34. The base member 30 also includes an expanded support portion 36 positioned between the first end 32 and the second end 34. The support portion 36 includes a series of threaded holes 38 each sized to receive a connector 40 that passes through one of a series of aligned passageways in the mounting bracket 28. In this manner, the connectors 40 secure the mounting bracket 28 to the base member 30. In the preferred embodiment of the invention, the connectors 40 are conventional screws that are received by the threaded holes 38 to attach the mounting bracket 28 to the support portion 36.

Since the mounting bracket 28 is typically sold in combination with the quiver 14, it is important that the quiver mounting arrangement 16 of the present invention can be used in combination with the different types of available quivers and mounting brackets 28. To accomplish this, as shown in FIG. 3, three threaded holes 38 are included in the base member 30. The arrangement of holes 38 has been designed to accommodate the passages formed in the mounting bracket, such as 28, for most commercially available quivers, such as 14, such that the base member 30 can receive and accept a variety of types of mounting brackets 28 that may have slightly different configurations. In the illustrated embodiment, the lower two holes 38 are used to receive connectors 40 while the upper hole 38 is unused. Holes 38 can be used in other combinations for other mounting member passageway configurations, and the arrangement of the threaded holes 38 thus allows the quiver mounting arrangement 16 of the present invention to be used with a variety of types of quivers 14.

In the preferred embodiment of the invention, the base member 30 is formed from rigid, lightweight plastic material having a thickness of approximately ¼ inch. The base member 30 has a generally flat, front face surface 42 and a corresponding flat, rear face surface.

Referring again to FIG. 2, an upper attachment strap 44 is coupled to the first end 32 of the base member 30. The upper attachment strap 44 includes a first end 46 and a second end 48 which overlap each other. The length of the upper attachment strap 44 between the first end 46 and the second end 48 is sufficient to surround the archer's leg 12 slightly below the knee. In the preferred embodiment of the invention, both the first end 46 and the second end 48 of the upper attachment strap 44 contain opposite, mating portions of a hook and loop connector, such as Velcro®, which enable attachment strap ends 46 and 48 to be wrapped about the archer's leg and secured together. The upper attachment strap 44 is securely attached to the first end 32 of the base member 30 by a pair of connectors 50. In the preferred embodiment of the invention, the connectors 50 are rivets that pass through the first end 32 of the base member 30 and the upper attachment strap 44. While this construction provides a fixed-position mounting of base member 30 to upper attachment strap 44, it is contemplated by the inventor that the upper attachment strap 44 could also be movable with respect to the base member 30 as long as the upper attachment strap 44 can be used to secure the base member 30 to the archer's leg.

The second end 34 of the base member 30 is coupled to a lower attachment strap 52. In the preferred embodiment of the invention, the lower attachment strap 52 passes through a slot 54 formed in the second end 34 of the base member 30. Preferably, the lower attachment strap 52 is a single, continuous loop of material that is formed from an elastic material. As shown in FIGS. 1 and 2, the lower attachment strap 52 is looped around the foot 56 of the archer and is retained under the instep of the archer's foot between the heel 58 and the forefoot 60. Since the lower attachment strap 52 is formed of an elastic material, the lower attachment strap 52 can be used with a variety of types and sizes of footwear.

to use the quiver assembly 10 of the present invention, the archer first positions the mounting bracket 28 on the support portion 36 of the base member 30. With the mounting bracket 28 positioned on the support portion 36, the archer aligns the passageways in the mounting bracket 28 with the corresponding threaded holes 38 contained in the base member 30. Once the passageways in the mounting bracket 28 are properly aligned, the archer uses the connectors 40 to securely attach the mounting bracket 28 to the base member 30. As previously discussed, since the base member 30 includes a series of threaded holes 38, the quiver mounting arrangement 16 of the present invention can be used along with a wide variety of currently available quivers 14 and mounting brackets 28.

After the mounting bracket 28 has been securely attached to the base member 30, the archer positions the base member 30 along the outer portion of the archer's lower leg 12 slightly below the knee, as shown in FIGS. 1 and 2. When the base member 30 is positioned as shown, the archer wraps the upper attachment strap 44 around the upper calf portion of his or her leg slightly below the knee, until the first end 46 and the second end 48 overlap each other. The archer then tightens the upper attachment strap 44 and joins the first end 46 to the second end 48 by the mating hook and loop connectors contained on each end. Although hook and loop connectors are shown in the preferred embodiment of the invention, it should be understood that other types of connectors, such as snaps or buckles, could be used while operating within the scope of the invention.

Once the upper attachment strap 44 has been securely connected around the archer's leg 12 slightly below the knee, the archer then stretches the lower attachment strap 52 and passes it over his or her forefoot, shown at 60, until the lower attachment strap 52 is positioned under the archer's instep. Since the base member 30 is positioned on the outside of the archer's lower leg, the outer portion of the lower attachment strap 52 extends along the outside of the archer's leg and the inner portion of the lower attachment strap 52 passes over the top of the archer's foot, as shown in FIG. 1, such that the lower attachment strap 52 can pass beneath the archer's foot 56. Since the lower attachment strap 52 is formed from an elastic material in the preferred embodiment of the invention and is tensioned when looped under the archer's foot 56 in this manner, the lower attachment strap 52 pulls the second end 34 of the base member 30 downward toward the archer's foot 56.

After the quiver mounting arrangement 16 has been attached to the archer's lower leg, the archer then slides the attachment portion 26 of the quiver 14 into the mating mounting bracket 28 to mount quiver 14 to quiver mounting arrangement 16. Once the attachment portion 26 of the quiver 14 has been secured in the mounting bracket 28, the archer can then remove arrows 18 from the quiver 14 when needed. To remove the arrows 18 from the quiver 14, the archer first pulls the top portion of the arrow out from the upper retaining member 24. After the upper portion of the arrow 18 has been removed from the upper retaining member 24, the archer can pull the arrow upward to remove the arrow tip from the lower compartment 20. Since the second end 34 of the support member 30 is secured around the archer's foot by the lower attachment strap 52, the upward, pulling movement on each arrow 18 does not move the base member 30. Without the lower attachment strap 52, the upward force created by the removal of an arrow from the quiver 14 would cause the base member 30 to rotate about the upper attachment strap 44.

Figure 4:
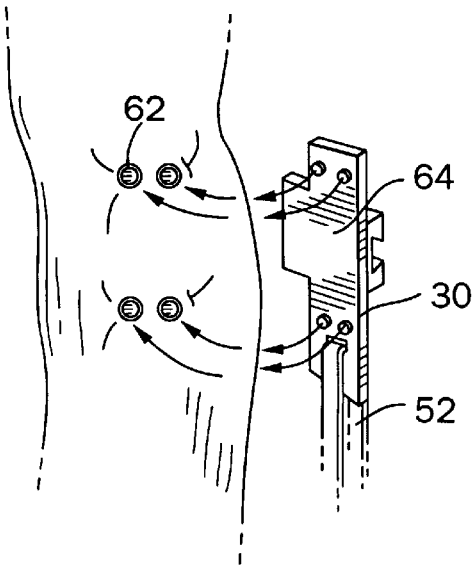
FIG. 4 is a partial isometric view illustrating a second embodiment for securing the quiver mounting arrangement to the leg of an archer.

In an alternate embodiment of the invention shown in FIG. 4, the base member 30 is attached to the pant leg of the archer by a plurality of snap devices 62. In this embodiment, either the male portion or the female portion of each snap device 62 is secured to the back face 64 of the base member 30, while the opposite, mating portion of the snap device 62 is sewn into the pant leg of the archer. Thus, to attach the base member 30 to the archer's lower leg, the archer simply snaps the mating portions of the plurality of snap devices 62 into one another. Although the snap devices 62 are sufficient to secure the base member 30 to the archer's pant leg, the lower attachment strap 54 is preferably still used to prevent the pant leg from being moved upward when an arrow 18 is removed from the quiver 14.

Although the quiver assembly 10 has been described as including the quiver mounting arrangement 16 that receives the mounting bracket 28 included with a separately purchased quiver 14, it is contemplated by the inventor that the mounting bracket 28 could be integrally formed with the base member 30. In such an embodiment, the entire quiver assembly 10, including the quiver 14 and the quiver mounting arrangement 16, could then be sold as a single package. Thus, it is contemplated by the inventor that the quiver mounting arrangement 16 could either be used with commercially available quivers 14, or could be incorporated into a single package including both the quiver mounting arrangement 16 and the quiver 14.

The quiver assembly 10 previously described is particularly useful for an archer when the archer is bow hunting in a tree stand. Typically, when an archer is hunting in a tree stand, the archer is often in a seated position. When in the seated position, the quiver assembly 10 of the present invention will present arrows in a particularly desirable fashion, since the quiver mounting arrangement 16 is only connected to the lower portion of the archer's leg below the knee. Thus, the arrows 18 will extend upward past the archer's knee into an easily accessible position for the archer. In this manner, the archer can access his supply of arrows 18 with relatively minimal motion, and thus relatively minimal noise.

It is recognized that various equivalents, alternatives and modifications to the invention as described are possible. Such equivalents, alternatives and modifications should be considered to fall within the scope of the following claims.

We claim:

1. In a quiver for holding arrows, the quiver having a mounting portion secured thereto, the improvement comprising a quiver mounting arrangement for mounting and positioning the quiver along a leg of an archer, the mounting arrangement comprising:

a base member having a mounting bracket attached thereto configured for receiving and holding the quiver by the mounting portion, the base member having a first end and a second end;

an upper attachment strap attached to the first end of the base member, the upper attachment strap having a length sufficient to surround a portion of the leg of the archer such that the first end of the base member is securable to the leg of the archer by the upper attachment strap; and a lower attachment strap attached to the second end of the base member, the lower attachment strap for passing under the instep of the foot of the archer to limit the movement of the base member.

2. The quiver mounting arrangement of claim 1 wherein the lower attachment strap is a continuous loop of material.

3. The quiver mounting arrangement of claim 1 wherein the lower attachment strap is formed from an elastic material.

4. The quiver mounting arrangement of claim 1 wherein the mounting bracket is removably attached to the base member.

5. The quiver mounting arrangement of claim 1 wherein the upper attachment strap includes a first end and a second end, the first and second ends of the upper attachment strap including mating portions of a hook and loop connector, such that the first end of the attachment strap is joinable to the second end of the attachment strap by the hook and loop connectors.

6. A quiver assembly for attachment to a leg of an archer, the assembly comprising:

a quiver for holding a plurality of arrows, the quiver including a mounting portion;

a base member for receiving and holding the quiver, the base member having a first end and a second end;

an upper attachment strap coupled to the first end of the base member, the upper attachment strap for surrounding a portion of the leg of the archer to secure the first end of the base member to the leg of the archer; and a lower attachment strap coupled to the second end of the base member, the lower attachment strap for passing under the instep of the foot of the archer to restrict movement of the second end of the base member.

7. The quiver assembly of claim 6 wherein the upper attachment strap surrounds the leg of the archer below the knee of the archer.

8. The quiver assembly of claim 6 wherein the lower attachment strap is formed from an elastic material.

9. A quiver assembly for attachment to a leg of an archer, the assembly comprising:

a quiver for holding a plurality of arrows, the quiver including a mounting portion;

a base member for receiving and holding the quiver, the base member having a first end and a second end;

an upper attachment strap coupled to the first end of the base member, the upper attachment strap for surrounding a portion of the leg of the archer to secure the first end of the base member to the leg of the archer;

a lower attachment strap coupled to the second end of the base member, the lower attachment strap for extending around the foot of the archer to restrict movement of the second end of the base member; and a mounting bracket attached to a portion of the base member between the first end and the second end, the mounting bracket having a shape corresponding to the mounting portion on the quiver such that the mounting portion on the quiver is retainable within the mounting bracket.

10. The quiver assembly of claim 9 wherein the mounting bracket is removably attached to the base member.

11. A quiver assembly for attachment to a leg of an archer, the assembly comprising:

a quiver for holding a plurality of arrows, the quiver including a mounting portion;

a base member positioned along the outside of the leg for receiving and holding the quiver, the base member having a first end, a second end, and a support portion positioned between the first end and the second end;

an upper attachment strap coupled to the first end of the base member, the upper attachment strap having a length sufficient to surround a portion of the leg of the archer to secure the first end of the base member to the leg of the archer;

a lower attachment strap coupled to the second end of the base member, the lower attachment strap being formed from an elastic material and having a length sufficient to extend around the foot of the archer to restrict movement of the second end of the base member; and a mounting bracket removably attached to the support portion of the base member, the mounting bracket having a shape corresponding to the mounting portion on the quiver such that the mounting portion on the quiver is receivable and retainable within the mounting bracket.

* * * * *